US006377768B1

(12) United States Patent
Hulin et al.

(10) Patent No.: US 6,377,768 B1
(45) Date of Patent: Apr. 23, 2002

(54) DEVICE AND METHOD FOR INKING A CHARGE PATTERN USING A TONER SPRAYING DEVICE

(75) Inventors: Jean-Philippe Hulin, Munich; Manfred Muenz, Erding; Martin Schleusener, Zorneding; Manfred Wiedemer, Ismaning, all of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/445,708

(22) PCT Filed: May 15, 1996

(86) PCT No.: PCT/EP98/02870

§ 371 Date: Apr. 10, 2000

§ 102(e) Date: Apr. 10, 2000

(87) PCT Pub. No.: WO98/57233

PCT Pub. Date: Dec. 17, 1998

(30) Foreign Application Priority Data

Jun. 12, 1997 (DE) ..... 197 24 950

(51) Int. Cl.[7] ..... G03G 15/03

(52) U.S. Cl. ..... 399/281; 399/266; 399/272; 399/290

(58) Field of Search ..... 399/281, 272, 399/265, 290, 289, 266

(56) References Cited

U.S. PATENT DOCUMENTS

| | | | | |
|---|---|---|---|---|
| 4,481,903 A | | 11/1984 | Haberhauer et al. | |
| 4,802,625 A | | 2/1989 | Buschor | |
| 5,482,214 A | | 1/1996 | Talacko | |
| 5,557,376 A | | 9/1996 | Landa et al. | |
| 5,919,309 A | * | 7/1999 | Kim et al. | 118/629 |

FOREIGN PATENT DOCUMENTS

| | | | |
|---|---|---|---|
| DE | 27 08 299 A1 | | 9/1977 |
| DE | 19857257 | * | 6/2000 |
| EP | 0 647 959 A1 | | 4/1995 |
| EP | 0 494 454 B1 | | 4/1996 |
| GB | 1124689 | | 8/1968 |
| JP | 61-4071 A | | 1/1986 |
| JP | 61-151675 A | | 7/1986 |
| JP | 03 251874 A | | 11/1991 |
| JP | 4-1782 A | | 1/1992 |

* cited by examiner

*Primary Examiner*—Quana M. Grainger
(74) *Attorney, Agent, or Firm*—Schiff Hardin & Waite

(57) ABSTRACT

A device and method for inking a charge pattern of a carrier medium. The device includes a toner sprayer that generates and directs a mixed toner stream onto a surface of an application element. The mixed toner stream includes a number of charge toner and air particles and forms a toner layer when the mixed toner stream contacts the application element surface. The application element is movably positioned in close proximity to the carrier medium for transferring the charged toner particles onto the charge pattern of the carrier medium for inking the same.

11 Claims, 2 Drawing Sheets

14
15

10
11
12
13
15
16
17
18
19
20
21
22
23

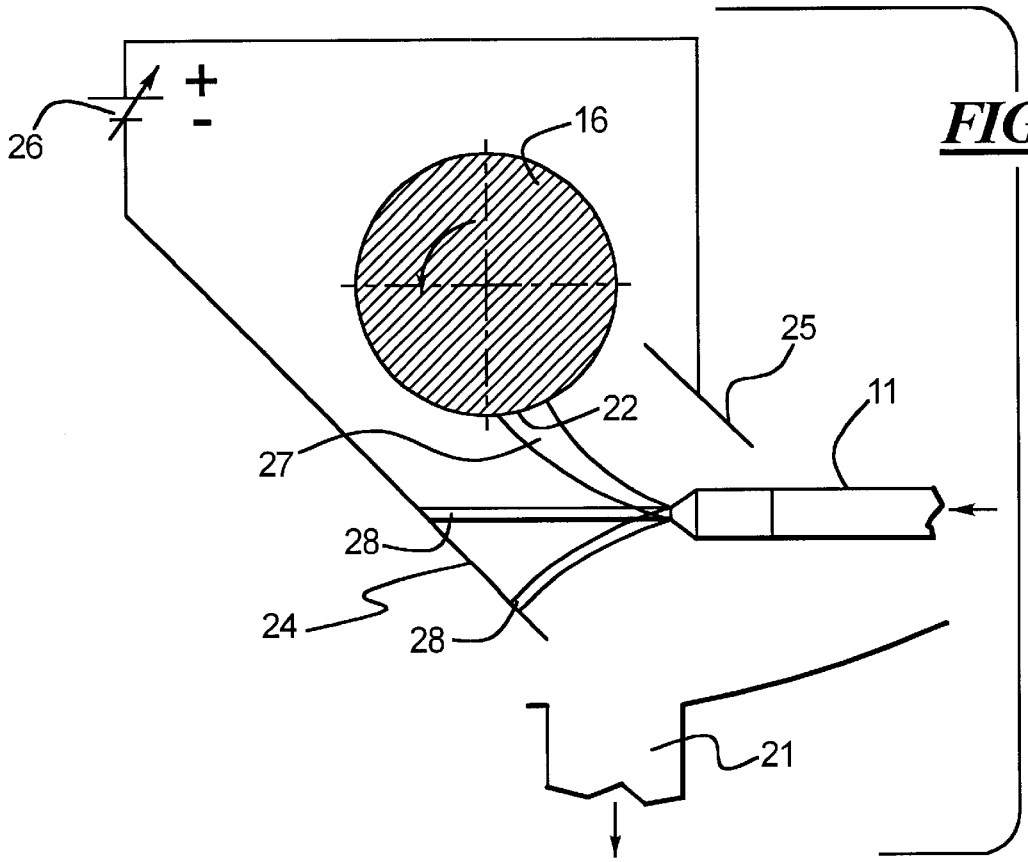
FIG. 3
FIG. 4
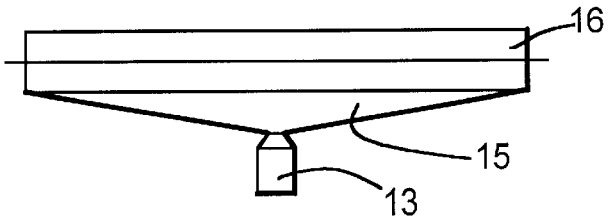
FIG. 5
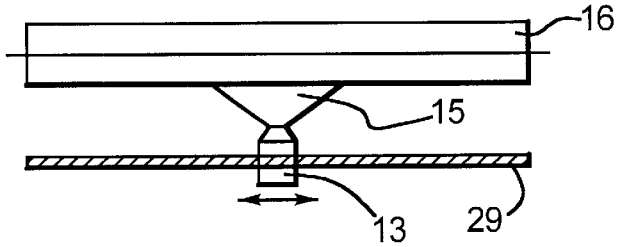
FIG. 6
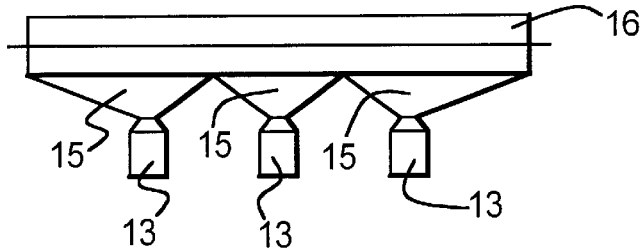

DEVICE AND METHOD FOR INKING A CHARGE PATTERN USING A TONER SPRAYING DEVICE

BACKGROUND OF THE INVENTION

1. Field of the Invention

The invention is directed to an apparatus and a method for inking a charge image via a toner sprayer for electrographic printer or copier or other like devices with high image carrier speed.

2. Description of the Prior Art

For developing electrostatic charge images or patterns printer devices having high image carrier speed, i.e. with an image carrier speed of 1 m per second and higher, developer systems are known that work with the assistance of two-component magnetic brush systems, with conductive single-component magnetic toner systems, with insulating non-magnetic single-component toner from a toner-air fluid, and with liquid developing systems.

The known two-component magnetic brush systems work with a mixture of toner particles and ferromagnetic carrier particles that triboelectrically charge one another. The soft-magnetic carrier particles form a brush in a magnetic field that is brought into direct contact with the charge image, for example on a photoconductor. The charged toner particles are deposited from the brush on the surface of the charge image-carrying element according to the distribution of the electrical field and of the toner charge. In order to achieve a high-quality image development, the toner particles must be very uniformly charged and the partially conductive brush must not discharge the photoconductor in contact. These conditions can only be met with great difficulty, particularly given a high developing speed and high toner throughput. Due to partial discharge of the photoconductor or inadequately uniform charging of all toner particles, undesired toner deposits, what is referred to as the background, therefore often occur. Due to the direct mechanical contact of the magnetic brush with the charge image-carrying element, moreover, a structuring of the toner image (what is referred to as brush marks) that has already been deposited or a fraying of image edges or a cavitation of large areas to be uniformly developed can arise.

Conductive one-component magnetic brush systems work without a carrier material. The toner particles themselves contain a ferromagnetic component. The toner particles form a brush structure in the magnetic field, charged toner particles being respectively located at the ends thereof. The charging of the toner particles ensues by charge transport from one toner particle to another proceeding from the carrier drum. A disadvantage of this developing method is that the ferromagnetic material component noticeably limits the color reproducibility of these toners. Moreover, the inking power (optical density) is often limited in that, due to the conductivity of the particle brush, only the respectively last particles are deposited and too weakly charged particles are picked up again. Further, the conductivity of the toner particles leads to limitations in the transfer from the photo conductor onto the ultimate image carrier onto a further intermediate carrier, particularly given electrostatic toner transfer.

When developing with insulating, non-magnetic one-component toner from a toner-air fluid, as known from E European Patent Document No P 04 94 454 B 1, toner is fluidized in a uniform air stream and charged in this fluid by a corona discharge, The charged toner is deposited on a conductive drum to which it adheres by electrostatic forces.

The toner can leap from the drum surface onto a surface with a charge image corresponding to the topical electrical field distribution and can thus develop an image-by-image toner image. One or more additional drums can be inserted between the aforementioned drum and the surface carrying the charge image in order to separate the toner particles having the correct charge polarity and the adequate charge amount from toner particles that are less charged or are charged with the wrong polarity. Given this development process, the obtainable image quality is physically limited both in view of the uniformity of the inking distribution as well as in view of the detail sharpness.

Added outlays also arise for stabilization of the fluid, the stability thereof decreasing with the function duration as a consequence of the electrical interactions.

In liquid developing systems, fine toner particles are dispersed in a carrier fluid in which they electrostatically charge compared to the particle environment in the liquid. The developer liquid is usually brought into contact with the surface of the element carrying the charge image (for example, photoconductor). The charged toner particles migrate in the direction that is prescribed by the electrical field and the toner charge. The "damp" toner image is then transferred onto the ultimate image carrier (usually paper). The remaining liquid then escapes from the toner image (ultimate image carrier) into the ambient air. This is a considerable disadvantage when the liquid is an organic solvent like the other isopars employed as carrier liquid. Liquid toner systems are also known wherein a highly concentrated solution of highly charged particles leaps—under the influence of an electrical field—from an application drum surface onto those surface regions of the element carrying the charge image to which the electrostatic field vector points, this being formed of the field vector and the toner charge in the liquid. These systems have likewise the disadvantage that organic solvents are employed as carrier liquids.

U.S. Pat. No. 4,481,903 discloses an apparatus for developing a latent electrostatic on a recording medium. The apparatus contains two brushes serving as charging device for the toner, these brushes having deflectable bristles that mechanically hurl the charged toner particles against a developer drum such that a toner layer is formed on the circumferential surface thereof. The toner adhering to the developer drum is then transported into the region of a developing gap where, after overcoming the developing gap, it inks the latent charge image on the recording medium.

SUMMARY OF THE INVENTION

An object of the invention is therefore to offer an apparatus and a method for low-disturbance development of a charge image given high image carrier speed in a printer or copier or other like device.

In the inventive developing apparatus, a uniform, homogeneous toner layer is first generated by powder coating on an application element, such as a drum. Subsequently, this toner layer is transferred in charge-image dependent fashion onto a carrier medium conducted past in close proximity. In particular, the individual toner particles leap over the developing gap and thus ink the charge image located on the carrier medium.

A low-disturbance inking of the charge image is possible on the basis of this principle even given a high image carrier speed (speed of the carrier medium of 1 m/sec. or higher). Both one-component toner as well as multi-component toner can be utilized as toner. The employment of one-component toner has the advantage that the toner can be chromatically mixed in the developer device given employment of the inventive developer device in color printer devices.

Toner sprayer device as known from powder coating systems can be employed in the invention. Such powder coating guns are disclosed, for example, by U.S. Pat. Nos. 5,482,214 and 4,802,625 that are incorporated herein by reference.

DESCRIPTION OF THE DRAWINGS

FIG. 3 is a schematic sectional view of the developer with appertaining deflection device.

FIG. 4 is a schematic illustration of a toner sprayer device with a broad spray region.

FIG. 5 is a schematic illustration of a toner sprayer device that is movable along an application element.

FIG. 6 is a schematic illustration of a toner sprayer device with a plurality of spray nozzles arranged next to one another.

DESCRIPTION OF THE PREFERRED EMBODIMENTS

Figures 1, 2:
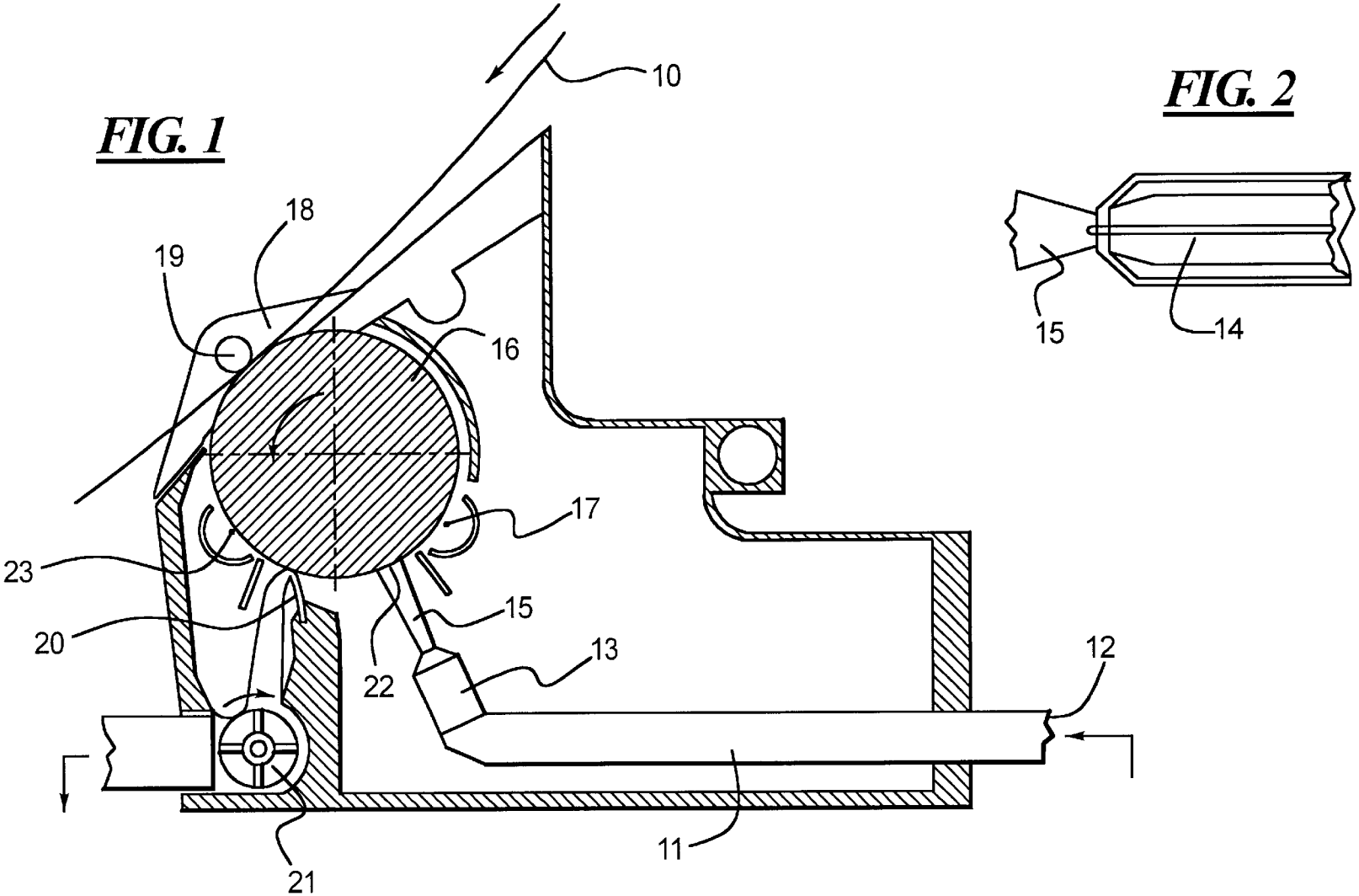
FIG. 1 is a schematic sectional view of a developer with a toner sprayer device.
FIG. 2 is a schematic sectional view of the mouthpiece region of the toner sprayer device with charging device.

A high-performance electrophotographic printing system (not shown in detail here) having a printing output of more than 200 pages/min. includes one or more of the developer devices shown in FIG. 1. These developer devices serve the purpose of inking a latent charge image applied on a carrier medium 10 with the assistance of a character generator with toner. The carrier medium 10 can thereby be a photoconductor drum, i.e. a metallic member with a photoconductive surface of, for example, $As_2Se_3$ or—as shown here—can be an OPC photoconductor band. Given the reversing developing method employed here, the photoconductor or, respectively, the carrier medium 10 is first charged to −500 V and is then discharged to −50 V character-dependently with the assistance of the character generator. This means that the carrier medium 10 is at approximately −500 V in the region of the carrier medium at which no toner image should arise and is at −50 V in the region of the toner image.

However, it is also possible to first charge the carrier medium to +500 V and to then discharge it character-dependently to +50 V.

The toner image is inked with the assistance of the illustrated developer device upon employment of one-component toner or of two-component toner as well that comprises toner particles having a size of approximately 10 $\mu$m on an arbitrary resin bases such as, for example, polystyrol or polyester and also comprises electromagnetic carrier particles in the case of two-component toner. The toner particles thereby deposit charge image-dependently on the photoconductor. After the developing process, they are transferred onto paper in the usual way and are subsequently fixed, for example in a thermal pressure fixing mechanism or other like mechanism.

The developer device contains a toner sprayer device 11 that can be constructed analogous to a powder coating mechanism. Such powder coating mechanism are disclosed, for example, by U.S. Pat. No. 5,482,214 and 802,625. The toner sprayer generally composed of a delivery tube 12 with a nozzle 13 shown in FIG. 2 that comprises includes an electrode 14 in the form of a corona discharge mechanism in its mouthpiece region. A mixed stream is generated in the toner sprayer device 11 from a toner-air mixture that includes toner particles having a defined toner charge. To this end, toner is dispersed in air in the pump system of the toner sprayer device as in a known powder coating mechanism, and this mixed stream is supplied via the delivery tube 12 to the nozzle 13, and a directed spray jet is thus produced. This usually occurs in that toner fluidized via an acceleration mechanism with a Venturi nozzle is sucked up from a fluid bed, is uniformly distributed in a transport air stream and accelerated to high speed. The electrode 14 is charged with a voltage of +5 or −5 KV or more and sprays charges onto the toner particles, which then exhibit a toner charge of, preferably, ±10 $\mu$C/g through ±30 $\mu$C/g. The electrode acting as corona discharge mechanism can be arranged in the mixed stream or in the immediate proximity of the mixed stream 15. It charges the toner particles in defined fashion.

It has been shown that a negative charging promotes the attainment of a high charge level. The toner application efficiency TAW thereby becomes more efficient. The toner application efficiency is defined as the ratio of the mass stream (toner) deposited on the acceptance surface (application element 16) to the mass stream (toner) transported in the air stream.

Instead of charging with the assistance of an electrode (14) (corona charging), it is also possible to triboelectrically charge the toner particles in a known way by contact interaction of the toner particles with an interaction surface.

An application element 16 is arranged in the region of the mixed stream 15. In the illustrated case, this is composed of a metal drum with a partially conductive surface of, for example, amorphous carbon, so that the spacing of the toner charge and the mirror charge thereof is great enough in order to enable adhesion of the toner to the application element 16 and small enough so that the required stripping field does not become all too great, since the charging of the photoconductor is limited. It is also possible to employ an endless band instead of a drum-shaped application element 16.

The application element 16 is moved in arrow direction by a motor. A corona device 17 is arranged at the application element, this serving the purpose of charging a toner layer applied on the application element 16 with the assistance of the toner sprayer device 11 with an ion current and thus homogenizing the charge in the toner layer. The surface of the application element 16 is located in tight proximity to the carrier medium 10, namely at a spacing that can be less than 100 $\mu$m, whereby the gap defines the actual developer region or, transfer region 18 in In order to assure this spacing, the carrier medium 10—the photoconductor band in this case—is guided in this region by a spacer drum 19. A stripper element 20 of elastic material is located following the transfer region 18 in moving direction, this serving the purpose of stripping residual toner from the application element and supplying it to a toner reservoir via a conveyor device 21. A further corona device 23 precedes the stripper element 20.

The function of the developer device is now explained in greater detail on the basis of FIG. 1.

First, a mixed stream 15 in the form of a spray jet of charged toner particles in a transport air stream is produced with the assistance of the toner sprayer device 11. In the illustrated reverse developing method that is shown, the application element 16 lies at an application potential of −450 V. Due to these voltage relationships in conjunction with the toner charge, the toner particles agglomerate to the surface of the application element 16 in an acceptance region 22. The agglomeration of the toner particles is thereby promoted by the kinetics (impulse) thereof. The kinetics are in turn dependent on the velocity of the transport air stream that carries the toner particles. The impulse of the toner particles raises the toner application efficiency TAW. They form a uniform, homogeneous layer that has a layer thickness of approximately 1–3 toner layers or more. This layer is charged with an ion current with the assistance of the corona charging mechanism 17 in order to thereby homogenize the charge in the layer. As a result of continued movement of the application element 16, the acceptance region 22 with the toner layer proceeds into the transfer region 18 with the developer gap, where the toner particles leap charge image-dependently from the application element 16 across the developer gap having a width of approximately 100 $\mu$m or less onto the charge image of the carrier medium 10 and ink the latter. In order to facilitate this leap, an auxiliary transfer voltage of, preferably, 200–500 V can be adjacent in the transfer region between the carrier medium 10 and the application element 16. It is activated during the entire developing duration. The toner particles collect on the charge image of the carrier medium 10 when a suitable toner charge is present, when the charge of the carrier medium 10 is correctly selected and what is referred to as the "jump potential" and the mechanical distance in the developer gap 18 are correctly selected. Given the illustrated exemplary embodiment with reverse developing, the toner charge amounts to between 10 and 30 $\mu$C/g with a −450 V potential of the application element. The auxiliary transfer voltage preferably amounts to 200–500 V. On the carrier medium 10, the toner-free areas lie at −500 V, the latent charge image at about −50 V. The field strength attacking the toner particles in the developer region amounts to about $8\times10^{-8}$ N. The toner particles thus deposit charge-dependently in, preferably, 1–2 toner layers in the discharged photoconductor region (−50 V).

The voltage and charge conditions described given the illustrated exemplary embodiment apply to reverse development, whereby a charged carrier medium is character-dependently discharged with the assistance of the character generator. In the positive developing principle, wherein a discharged carrier medium 10 is charged character-dependent, analogous, inverse voltage conditions apply that, however, are dependent on material.

Since, when developing the charge images on the carrier medium, not all toner particles jump onto the carrier medium, these residual toner particles must be removed from the application element 16 during the further course. To this end, they are first exposed to a further corona charging mechanism 23 that loosens the adhesion of the toner particles on the surface of the application element 16. Subsequently, they are stripped off with the assistance of the stripper element 20 and are resupplied to the toner reservoir via the toner conveying device 21 or are cleaned via a recycling system and then delivered to the toner reservoir. The application element 16 without residual toner is then again sprayed with toner in the acceptance region 22. This process cycles continuously. polarity impinge the application element 16, a deflection element that can be added according to the illustration of FIG. 3. This is essentially composed of an activatable electrical deflection field 26 between a collecting region 24 and a deflection electrode 25, whereby the pole direction of the field 26 is symbolically shown. The toner sprayer device is thereby directed such that, given absence of the auxiliary electrical field 26, the mid-point of the jet leads past the application element 16 at a distance therefrom and impinges in the collecting region 24.

When the deflection field 26 is cut in, the toner particles having the correct charge polarity (negative particles) and an adequately high charge amount (10–30 $\mu$C.g) are deflected in a curved path 27 onto the application element 16. Particles having inadequate charge amount and a different polarity fly past the application element (16) and impinge the collecting region 24 in the region of the jets 28. This collecting region 24 can be composed of a corresponding plate on which they collect and are then resupplied to the toner reservoir via the conveyor means 21.

In order to produce a uniform toner layer over the entire acceptance region 22 of the application element 16, the nozzle 13 can be fashioned as a flat nozzle according to the illustration of FIG. 4 with a nozzle tip as disclosed, for example, by U.S. Pat. No. 5,482,214. According to the illustration of FIG. 5, it is also possible to move the toner sprayer device 11, i.e. the nozzle 13, along the application element 16 during application with the assistance of a spindle-shaped drive mechanism 29. It is also possible according to the illustration of FIG. 6 to arrange a plurality of toner sprayer devices (11) with a plurality of nozzles 13 whose spray area cover the entire acceptance region 22 of the application element 16

A uniform toner application onto the application element 16 or the moving acceptance area thereof can also be achieved by a dense atomization of the toner in the environment of the acceptance region 22 of the application element 16, whereby high toner charges of approximately 10–30 $\mu$C/g are required for a fast process management, i.e. with working speeds of the carrier medium 10 of approximately 1 m/sec. and higher. These ton high a precipitation of the toner on the acceptance region 22 of the application element 16 in a very short time, i.e. in a time of less than 0.1 sec.

Although modifications and changes may be suggested by those skilled in the art, it is the intention of the inventors to embody within the patent warranted hereon all changes and modifications as reasonably and properly come within the scope of their contribution to the art.

What is claimed is:

1. An inking device for developing a charge pattern of a carrier medium, comprising:

toner sprayer device including at least one mountable nozzle for generating a directed mixed toner stream wherein said directed mixed stream includes a mixture of a plurality of toner and air particles and said toner sprayer device including a toner particle charging mechanism for charging each of said toner particles with an ion current to generate charged toner particles; and an application element mountably arranged within said inking device for receiving at least a portion of an amount of said directed mixed toner stream, said application element including an application surface, said application surface being charged with an application element potential for accepting at least a portion of said charged toner particles, said application surface being movably positioned in close proximity to said carrier medium for transferring said charged toner particles onto said charge pattern of said carrier medium.

2. An inking device according to claim 1, further comprising: an electrical deflection field wherein said electrical deflection field is applied between said toner sprayer device and said application element.

3. An inking device according to claim 1, further comprising: a voltage generator producing an auxiliary transfer voltage so that said auxiliary transfer voltage is applied during said transfer of said charged toner particles from said application element surface to said carrier medium.

4. An inking device according to claim 1, wherein said application element is a drum.

5. An inking device according to claim 1, wherein said application element is an endless band.

6. An inking device according to claim 1, wherein each of said mountable nozzles generates said directed mixed toner stream having a directed mixed toner spray region for covering an acceptance region of said application element surface.

7. An inking device for developing a charge pattern of a carrier medium, comprising:

a toner sprayer device including a mountable nozzle for generating a directed mixed toner stream wherein said directed mixed stream includes a mixture of a plurality of toner and air particles and said toner sprayer device including a toner particle charging mechanism for charging each of said toner particles with a respective toner particle charge to generate charged toner particles;

an application element mountably arranged within said inking device for receiving at least a portion of an amount of said directed mixed toner stream, said application element including an application surface, said application surface being charged with an application element potential for accepting at least a portion of said charged toner particles, said application surface being movably positioned in close proximity to said carrier medium for transferring said charged toner particles onto said charge pattern of said carrier medium;

means for applying an electrical deflection field between said toner sprayer device and said application element;

a toner particle collecting region being disposed so that said directed mixed toner stream impinges said toner particle collection region when said electrical deflection field is not applied; and an acceptance region being disposed on said application element surface so that at least a portion of said charged toner particles of said directed mixed toner stream are applied to said acceptance region of said application element surface and at least a portion of said charged toner particles impinge said collection region when said electrical deflection field is applied.

8. An inking device according to claims 7, further comprising: a toner reservoir connected to said toner particle collection region via a toner transport member.

9. An inking device for developing a charge pattern of a carrier medium, comprising:

a toner sprayer device including a mountable nozzle for generating a directed mixed toner stream wherein said directed mixed stream includes a mixture of a plurality of toner and air particles and said toner sprayer device including a toner particle charging mechanism for charging each of said toner particles with a respective toner particle charge to generate charged toner particles;

an application element mountably arranged within said inking device for receiving at least a portion of an amount of said directed mixed toner stream, said application element including an application surface, said application surface being charged with an application element potential for accepting at least a portion of said charged toner particles, said application surface being movably positioned in close proximity to said carrier medium for transferring said charged toner particles onto said charge pattern of said carrier medium; and a drive mechanism which moves said directed mixed toner stream along said application element surface.

10. An inking device for developing a charge pattern of a earner medium, comprising:

a plurality of toner sprayer devices, each toner sprayer device including a mountable nozzle for generating a directed mixed toner stream wherein said directed mixed stream includes a mixture of a plurality of toner and air particles and each toner sprayer device including a toner particle charging mechanism for charging each of said toner particles with a respective toner particle charge to generate charged toner particles; and an application element with an application surface mountably arranged within said inking device for receiving at least a portion of an amount of said directed mixed toner stream of each toner sprayer device, said application surface being charged with an application element potential for accepting at least a portion of said charged toner particles, said application surface being movably positioned in close proximity to said carrier medium for transferring said charged toner particles onto said charge pattern of said carrier medium so that each of said toner sprayer devices generates a directed mixed toner stream for covering a respective acceptance region of said application element surface.

11. A method for inking a charge pattern of a carrier medium employing a toner sprayer device, comprising the steps of:

generating a directed mixed toner stream of a plurality of charged toner particles being dispersed within a transport air stream by charging the particles with an ion current;

providing a movably mounted application element, said application element including an application element surface for accepting at least a portion of an amount of said directed mixed toner stream;

charging said application element surface with an application element potential;

spraying an amount of said directed mixed toner stream onto at least a portion of said application element surface;

forming a toner layer on at least a portion of said application element surface, said toner layer comprising at least a portion of said charged toner particles; and transferring said charged toner particles of said toner layer onto said charge pattern of said carrier medium for inking said charge image.

* * * * *